US007941880B2

(12) United States Patent
Choi

(10) Patent No.: US 7,941,880 B2
(45) Date of Patent: May 17, 2011

(54) CONNECTING STRUCTURE FOR A BED FOOT

(76) Inventor: Kwan-Jun Choi, KyoungNam (KR)

( * ) Notice: Subject to any disclaimer, the term of this patent is extended or adjusted under 35 U.S.C. 154(b) by 0 days.

(21) Appl. No.: 12/518,102

(22) PCT Filed: Jul. 27, 2007

(86) PCT No.: PCT/CN2007/002273

§ 371 (c)(1),
(2), (4) Date: Jun. 6, 2009

(87) PCT Pub. No.: WO2008/064549

PCT Pub. Date: Jun. 5, 2008

(65) Prior Publication Data

US 2010/0235990 A1 Sep. 23, 2010

(30) Foreign Application Priority Data

Nov. 29, 2006 (CN) ..... 2006 2 0156412 U
Feb. 16, 2007 (CN) ..... 2007 2 0006427 U

(51) Int. Cl.
*A47C 19/02* (2006.01)
*A47B 3/087* (2006.01)

(52) U.S. Cl. ..... 5/310; 5/313.1; 5/316; 5/112; 5/200.1; 108/128; 108/160; 248/188.6; 248/188.91

(58) Field of Classification Search ..... 5/110, 112, 5/114, 200.1, 201–203, 282.1, 305, 307, 5/301, 312, 313.1, 314.1, 315.1, 316; 108/128, 108/131, 132, 160; 248/188.6, 188.91
See application file for complete search history.

(56) References Cited

U.S. PATENT DOCUMENTS 1,330,533 A * 2/1920 Hellyer ..... 5/213
1,624,965 A * 4/1927 Moore ..... 5/114
1,694,420 A * 12/1928 Joselowitz ..... 5/112
1,818,036 A * 8/1931 Brown ..... 5/112
2,561,718 A * 7/1951 Weisman ..... 5/310
2,651,352 A * 9/1953 Beardsley ..... 297/19
2,837,392 A * 6/1958 Straits ..... 108/160

* cited by examiner

*Primary Examiner* — Michael Trettel

(57) ABSTRACT

The present invention discloses a connecting structure for a bed foot. The bed foot is pivotally connected to a bottom of a bed board frame. An inner side of the bed foot is pivotally connected with at least one support rod. The support rod has a free end formed with a through hole. The bottom of the bed board frame is provided with a protruding post corresponding in position to the through hole. The through hole has an opening at one side thereof so that the through hole is able to engage with the protruding post through the opening, without aiming at the protruding post. Accordingly, the operation is very convenient and quick.

2 Claims, 5 Drawing Sheets

CONNECTING STRUCTURE FOR A BED FOOT

BACKGROUND OF THE INVENTION

1. Field of the Invention

The present invention relates to a bed frame, and more particularly to a connecting structure for a bed foot.

2. Description of the Prior Art

As shown in FIG. 1, a conventional bed frame comprises a bed board frame 1 and a bed foot 2. The bed foot 2 is pivotally connected to a bottom of the bed board frame 1. In order to support the bed foot 2 securely, an inner side of the bed foot 2 is pivotally connected with at least one support rod 3. The support rod 3 has a free end formed with a through hole 31. The bottom of the bed board frame 1 is provided with a protruding post 11 corresponding in position to the through hole 31. When in use, the through hole 31 of the support rod 3 is inserted onto is the protruding post 11 so that the bed board frame 1, the bed foot 2, and the support rod 3 are in a triangular form to support the expanded bed frame securely.

However, this kind of operation is not convenient. The through hole 31 of the support post 3 is slightly larger in diameter than the protruding post 11. It is not easy to aim at the protruding post 11 when the through hole 31 is inserted onto the protruding post 11, referring to FIG. 2. Particularly, if there are two support rods 3, it is more difficult to aim at the two protruding posts 11 simultaneously. This is very inconvenient to operate. In addition, because the support rod 3 is a round rod, it is necessary to flatten two ends of the support rod 3 for connecting with the bed board frame 1 and the bed foot 2 for mounting easily. This increases the difficulty in manufacturing.

SUMMARY OF THE INVENTION

The primary object of the present invention is to provide a connecting structure for a bed foot. When in an expanded status, a support rod is in conjunction with a protruding post of a bed board frame for convenient operation.

According to the present invention, there is provided a connecting structure for a bed foot, the bed foot being pivotally connected to a bottom of a bed board frame, an inner side of the bed foot being pivotally connected with at least one support rod, the support rod having a free end formed with a through hole, the bottom of the bed board frame being provided with a protruding post corresponding in position to the through hole, and characterized by: the through hole having an opening at one side thereof.

Preferably, a trough is formed above the through hole and the opening, the trough having a diameter larger than diameters of the is through hole and the opening, the protruding post having a threaded section, a nut being screwed to the threaded section of the protruding post and located in the trough of the support rod after being tightened.

Preferably, the support rod is a flat rod.

Preferably, the opening has a diameter equal to the diameter of the through hole, thereby the free end of the support rod being formed with a U-shaped hole.

Alternatively, the opening has a diameter smaller than the diameter of the through hole, thereby the free end of the support rod being formed with a C-shaped hole.

The support rod has the free end formed with the through hole. The through hole has the opening at one side thereof so that the through hole is able to engage with the protruding post through the opening, without aiming at the protruding post. According, the operation is very convenient and quick.

In addition, the trough is formed above the through hole and the opening to accommodate the nut screwed to the threaded section of the protruding post. The side of the nut holds against the edge of the trough, which prevents the through hole from disengaging from the protruding post to ensure the security in use. Furthermore, the support rod is a flat rod. It is not necessary to flatten the end of the support rod, decreasing the procedure and cost of manufacture.

DETAILED DESCRIPTION OF THE PREFERRED EMBODIMENTS

Figure 1:
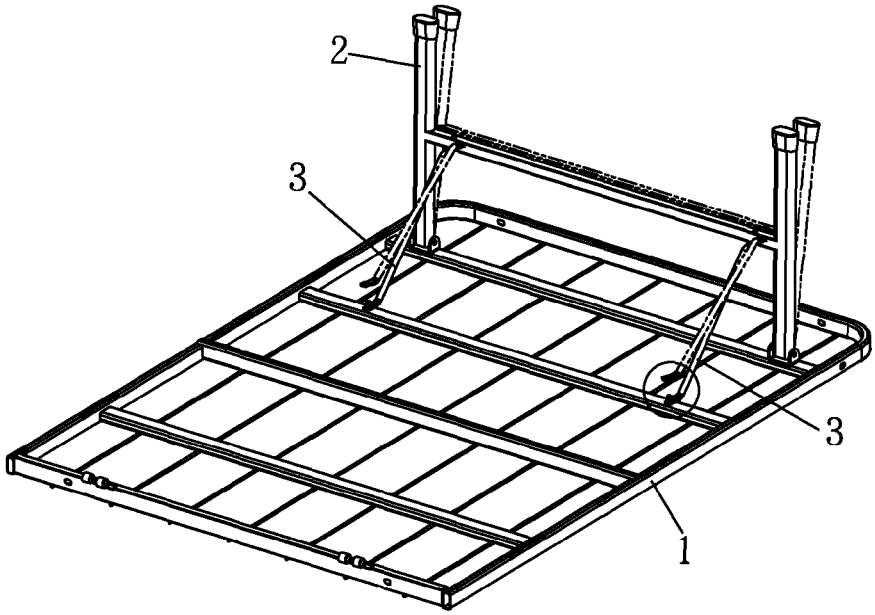
FIG. 1 Prior Art
FIG. 1 is a partially perspective view of a conventional bed frame.
Figure 2:
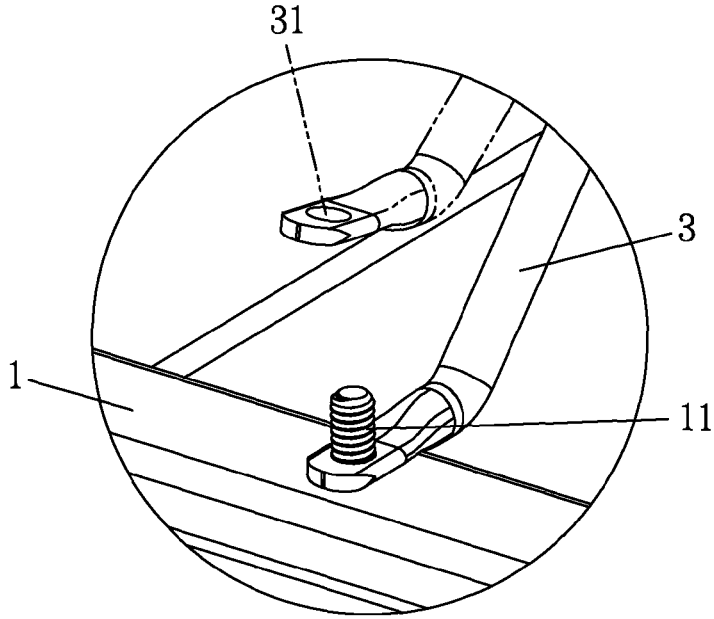
FIG. 2 Prior Art
FIG. 2 is a partially enlarged view of FIG. 1.
Figure 3:
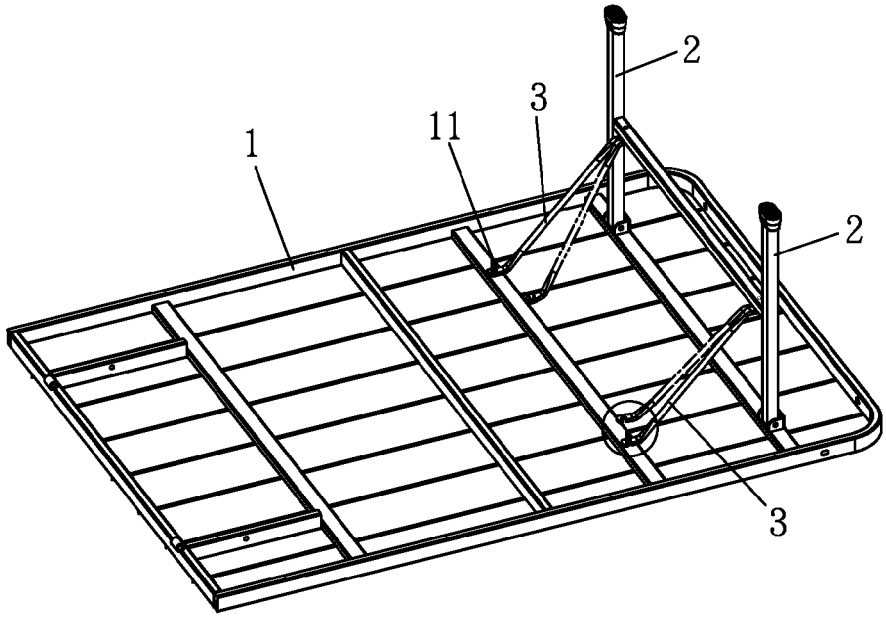
FIG. 3 is a partially perspective view of a first preferred embodiment of the present invention.
Figure 4:
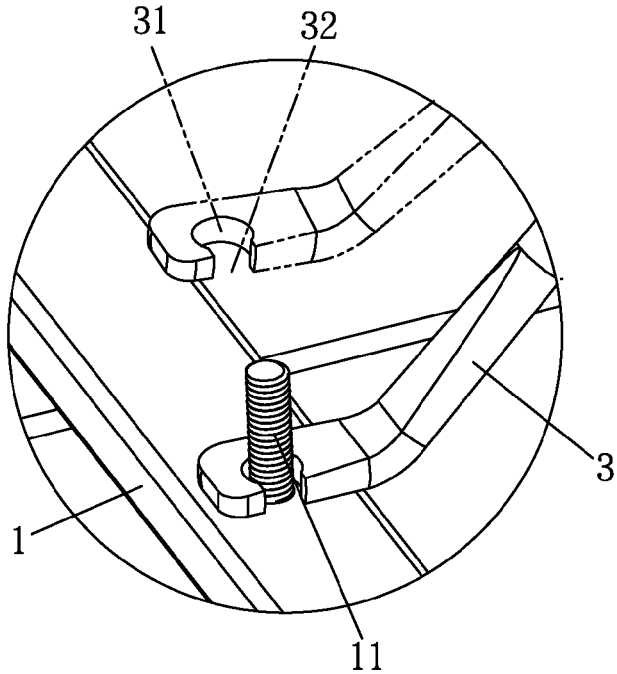
FIG. 4 is a partially enlarged view of FIG. 3.

As shown in FIGS. 3 and 4, a collapsible bed frame according to a first preferred embodiment of the present invention comprises a bed board frame 1 and a bed foot 2. The bed foot 2 is pivotally connected to a bottom of the bed board frame 1. An inner side of the bed foot 2 is pivotally connected with at least one support rod 3. The support rod 3 has a free end formed with a through hole 31. The bottom of the bed board frame 1 is provided with a protruding post 11 corresponding in position to the through hole 31. In this embodiment, the through hole 31 has an opening 32 at one side thereof. The opening 32 has a diameter equal to the diameter of the through hole 31 so that the free end of the support rod 3 is formed with a U-shaped hole. The diameter of the opening 32 may be smaller than the diameter of the through hole 31 so that the free end of the support rod 3 is formed with a C-shaped hole.

When the bed frame is expanded, the bed foot 2 will be extended and the support rod 3 will be pulled with the through hole 31 at the free end engaging with the protruding post 11 of the bed board frame 1 through the opening 32 so that the bed board frame 1, the bed foot 2, and the support rod 3 are in a triangular form to support the bed frame securely.

When the free end of the support rod 3 is formed with a C-shaped hole, this design will prevent the through hole 31 from disengaging from is the protruding post 11 to ensure the security in use.

Figure 5:
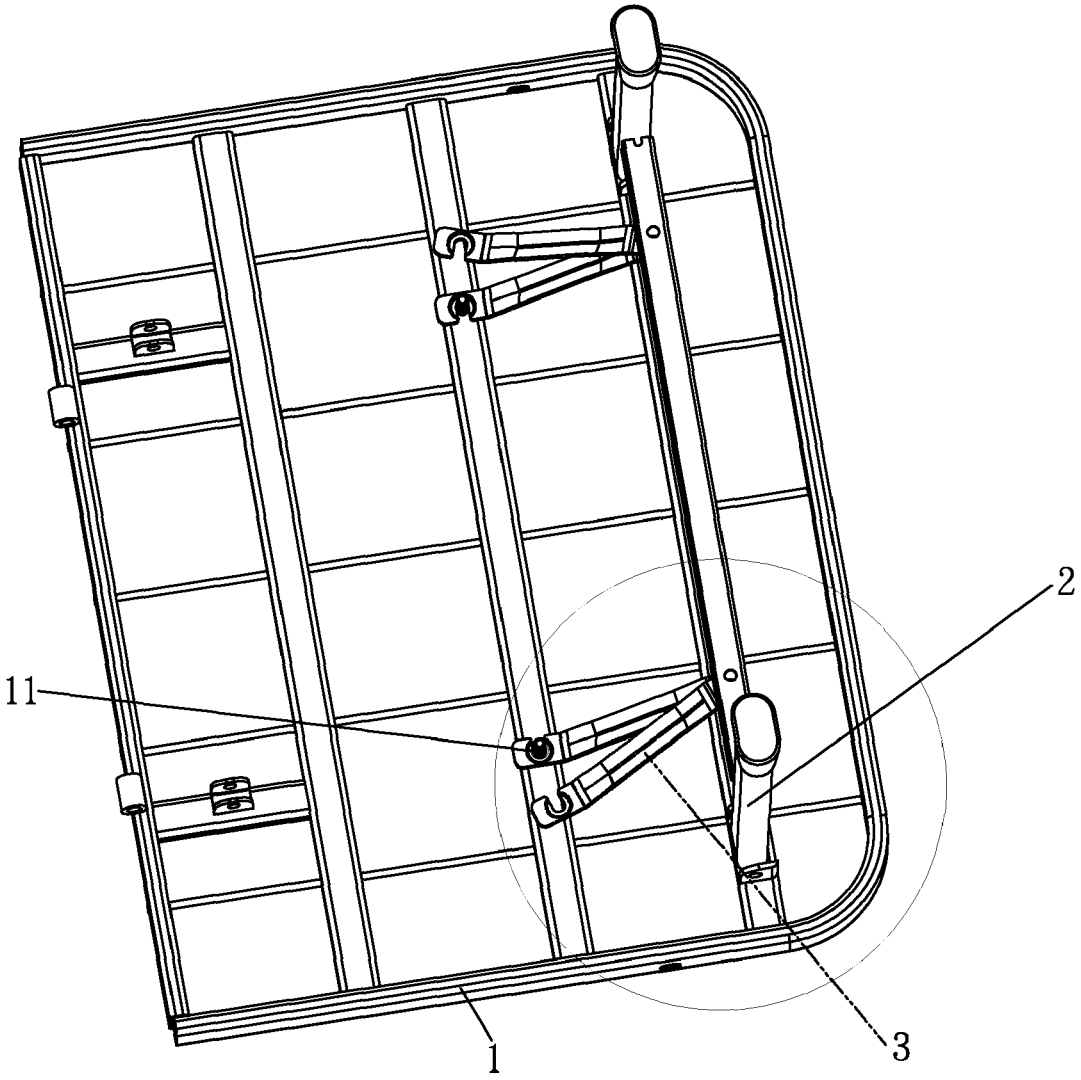
FIG. 5 is a partially perspective view of a second preferred embodiment of the present invention.
Figure 6:
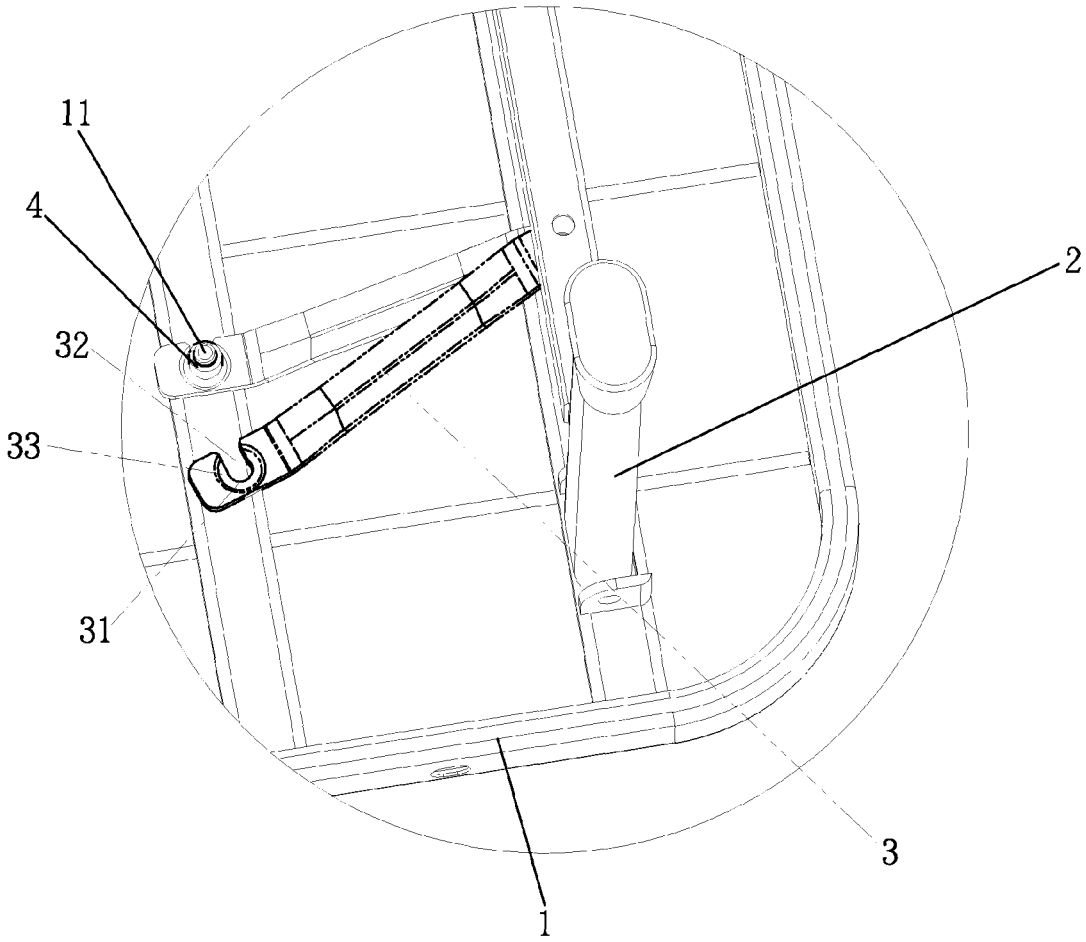
FIG. 6 is a partially enlarged view of FIG. 5.
Figure 7:
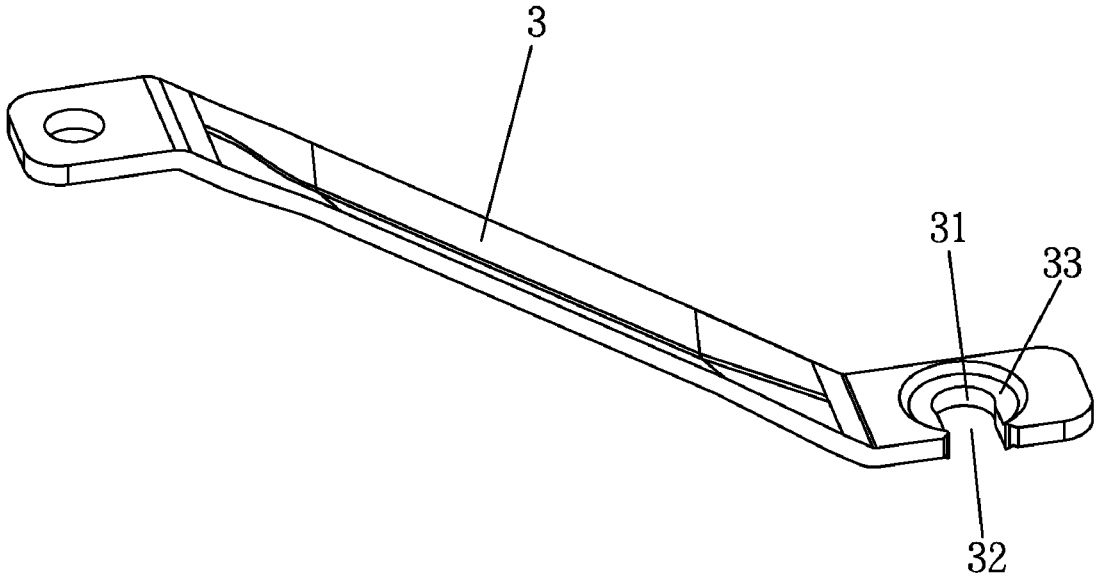
FIG. 7 is a perspective view of a support rod of the second preferred embodiment of the present invention.

FIGS. 5 and 6 show a second preferred embodiment of the present invention, which is substantially similar to the first preferred embodiment with the exceptions described hereinafter. The support rod 3 is a flat rod, as shown in FIG. 7. A trough 33 is formed above the through hole 31 and the opening 32. The trough 33 has a diameter larger than those of the through hole 31 and the opening 32. The protruding post 11 provided at the bottom of the bed board frame 1 has a threaded section.

When the bed frame is expanded, the bed foot 2 will be extended and the support rod 3 will be pulled with the through hole 31 at the free end engaging with the protruding post 11 of the bed board frame 1 through the opening 32. A nut 4 is screwed to the threaded section of the protruding post 1 and located in the through 33 of the support rod 3 after being tightened. Accordingly, the bed board frame 1, the bed foot 2, and the support rod 3 are in a triangular form to support the bed frame securely.

Particularly, the side of the nut 4 holds against the edge of the trough 33, which prevents the through hole 31 from disengaging from the protruding post 11 to ensure the security in use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A connecting structure for a bed foot, the bed foot being pivotally connected to a bottom of a bed board frame, an inner side of the bed foot being pivotally connected with at least one support rod, the support rod having a free end formed with a through hole, the bottom of the bed board frame being provided with a protruding post corresponding in position to the through hole, and characterized by the through hole having an opening at one side thereof, wherein a trough is formed above the through hole and the opening, the trough having a diameter larger than diameters of the through hole and the opening, the protruding post having a threaded section, a nut being screwed to the threaded section of the protruding post and located in the trough of the support rod after being tightened.

2. A connecting structure for a bed foot, the bed foot being pivotally connected to a bottom of a bed board frame, an inner side of the bed foot being pivotally connected with at least one support rod, the support rod having a free end formed with a through hole, the bottom of the bed board frame being provided with a protruding post corresponding in position to the through hole, and characterized by the through hole having an opening at one side thereof, wherein the opening has a diameter smaller than the diameter of the through hole, thereby the free end of the support rod being formed with a C-shaped hole.

* * * * *